US009318835B2

(12) United States Patent
Chen et al.

(10) Patent No.: US 9,318,835 B2
(45) Date of Patent: Apr. 19, 2016

(54) FLIP-COVER RECEPTOR CONNECTOR, AND RF PLATE CABLE AND CABLE END CONNECTOR USED IN CONJUNCTION THEREWITH

(71) Applicant: HARUMOTO TECHNOLOGY (SHEN ZHEN) CO., LTD., Shenzh (CN)

(72) Inventors: Shih-Chieh Chen, Taipei (TW); Chia-Hsin Wang, Taipei (TW); Chin-Chuan Kung, Taipei (TW)

(73) Assignee: HARUMOTO TECHNOLOGY (SHEN ZHEN) CO., LTD., Shenzh (CN)

( * ) Notice: Subject to any disclaimer, the term of this patent is extended or adjusted under 35 U.S.C. 154(b) by 0 days.

(21) Appl. No.: 14/691,282

(22) Filed: Apr. 20, 2015

(65) Prior Publication Data

US 2015/0325941 A1 Nov. 12, 2015

(30) Foreign Application Priority Data

Apr. 23, 2014 (CN) ..... 2014 1 0164751

(51) Int. Cl.

| | |
|---|---|
| ***H01R 13/447*** | (2006.01) |
| ***H01R 13/627*** | (2006.01) |
| ***H01R 4/28*** | (2006.01) |
| ***H01R 9/05*** | (2006.01) |
| ***H01R 13/6581*** | (2011.01) |
| ***H01R 13/6597*** | (2011.01) |
| *H01R 12/75* | (2011.01) |

(52) U.S. Cl.

CPC ..... *H01R 13/447* (2013.01); *H01R 4/28* (2013.01); *H01R 9/0524* (2013.01); *H01R 13/627* (2013.01); *H01R 13/6581* (2013.01); *H01R 13/6597* (2013.01); *H01R 12/75* (2013.01)

(58) Field of Classification Search

CPC ..... H01R 13/447; H01R 13/627; H01R 4/28; H01R 13/6597

See application file for complete search history.

(56) References Cited

U.S. PATENT DOCUMENTS

| | | | | |
|---|---|---|---|---|
| 2004/0110410 | A1* | 6/2004 | Boeck | H01R 4/2433 439/417 |
| 2007/0280603 | A1* | 12/2007 | Sakata | H01R 13/6594 385/88 |
| 2009/0208168 | A1* | 8/2009 | Ishikawa | H01R 13/113 385/14 |
| 2009/0297101 | A1* | 12/2009 | Ono | G02B 6/4201 385/53 |
| 2010/0184330 | A1* | 7/2010 | Wu | H01R 4/04 439/607.28 |
| 2011/0151708 | A1* | 6/2011 | Kaneko | H01R 13/65802 439/404 |

* cited by examiner

*Primary Examiner* — Briggitte R Hammond
(74) *Attorney, Agent, or Firm* — Chun-Ming Shih

(57) ABSTRACT

A flip-cover receptor connector, and a RF (radio frequency) plate cable and a cable end connector used in conjunction therewith are provided. A receptor insulator is provided concavely with a placement space. A metal cover may be forced to rotate pivotally until fastening with the receptor insulator, thereby movement of the RF plate cable or the cable end connector in the placement space of the receptor insulator is restricted. As such, the movement of the RF plate cable or the cable end connector may be restricted, such that it is not easy to leave the placement space of the receptor insulator due to external force impact by fastening the metal cover and the receptor insulator even though height of the flip-cover receptor connector is very small.

7 Claims, 10 Drawing Sheets

FLIP-COVER RECEPTOR CONNECTOR, AND RF PLATE CABLE AND CABLE END CONNECTOR USED IN CONJUNCTION THEREWITH

CROSS-REFERENCE TO RELATED APPLICATIONS

This application claims the priority of China Patent Application No. 201410164751.7 filed on Apr. 23, 2014, in the State Intellectual Property Office of the P.R.C., the disclosure of which is incorporated herein by reference.

BACKGROUND OF THE INVENTION

1. Field of the Invention

The invention relates to a receptor connector and a RF (radio frequency) cable and a cable end connector used in conjunction therewith, more specifically to a flip-cover receptor connector, and a RF plate cable and a cable end connector used in conjunction therewith.

2. Descriptions of the Related Art

It is understood that a coaxial cable is usually used for radio-frequency signal transmission of various electronic products. However, as electronic products tend to miniaturization, sizes of coaxial cables and connectors thereof used in the electronic products are requested to be reduced significantly. Generally, the coaxial cables may be in electrical communication with receptor connectors soldered on circuit boards of electronic products (not shown) by cable end connectors to deliver signals. As shown in FIG. 1, a middle portion of a receptor connector 1 is provided with a columnar receptor central terminal 11 and a cylindrical receptor shielding terminal 13. The receptor shielding terminal 13 is arranged around the receptor central terminal 11. A bottom side of the receptor central terminal 11 is extended out of a receptor central terminal pin 12. A bottom side of the receptor shielding terminal 13 is extended out of a receptor shielding terminal pin 14. These pins 12, 14 are connected onto a designated location of a circuit board by SMT soldering or other connection way in use.

Refer to FIG. 2, which is a schematic view of a conventional cable end connector. As shown in FIG. 2, the cable end connector 2 includes a cable end central terminal 21 and a cable end shielding terminal 22, the cable end central terminal 21 being in electrical communication with a central conductor of a coaxial cable (known as core wire, not shown), the cable end shielding terminal 22 being in electrical communication with external conductors of a coaxial cable (not shown). The cable end connector 2 may be mated to the receptor connector 1 as shown in FIG. 1 for the cable end central terminal 21 to be in electrical communication with the receptor central terminal 11, and for the cable end shielding terminal 22 to be in electrical communication with the receptor shielding terminal 13, in order for the coaxial cable to be in RF signal communication with a circuit board of an electronic product. Refer to FIG. 3 for a mating process of the conventional cable end connector and the receptor connector. The cable end connector 2 moves downwards to mate the receptor connector 1. With an interference force (also known as mating force) generated between the receptor connector 1 and the cable end connector 2 due to contact, mating between the cable end connector 2 and the receptor connector 1 is maintained (refer to FIG. 4).

However, with thinning requirement of sophisticated mobile electronic products, such as smart phones in recent years, entire height of cable end connectors and receptor connectors used in conjunction therewith is requested to be reduced continuously. For example, the entire height of the cable end connectors and the receptor connectors has been reduced from original 3.5 mm to 1.2 mm, and even to 1.0 mm below. Although smaller entire height meets thinning trend of electronic products, it will result in insufficient mating force between connectors due to insufficient contact area (i.e., insufficient interference height) between the cable end connector and the receptor connector, such that the cable end connector may be detached from the receptor connector due to external force impact, and normal operation of electronic products is influenced, and even more, the electronic products are damaged.

From above, how to reduce the total height of the receptor connector and the cable end connector used in conjunction therewith under guarantee of mating between the cable end connector and the receptor connector is an issue concerned urgently by those skilled in the art.

SUMMARY OF THE INVENTION

In view of various problems of prior arts mentioned above, main object of the invention is to provide a flip-cover receptor connector not only to fasten a RF plate cable and a cable end connector used in conjunction therewith effectively, but also to reduce a total height of the RF plate cable and the cable end connector used in conjunction therewith effectively.

To achieve above object and other objects, the invention serves to provide a flip-cover receptor connector used in conjunction with a RF plate cable or a cable end connector joined with a coaxial cable, including a receptor insulator, a receptor central terminal, a receptor shielding terminal and a metal cover. The receptor insulator is provided concavely with a placement space, the RF plate cable or the cable end connector being capable of entering the placement space. The receptor central terminal is provided at the receptor insulator and having a receptor central terminal contact exposed at the bottom of the placement space of the receptor insulator for receiving an electrical signal from a central conductor of the RF plate cable or the coaxial cable. The receptor shielding terminal is arranged at the receptor insulator, having a receptor shielding terminal contact exposed at a lateral side of the placement space of the receptor insulator for receiving an electrical signal from external conductors of the RF plate cable or the coaxial cable. The metal cover, one end being pivoted on the receptor insulator, another end having a fastening structure, can be forced to rotate pivotally until the fastening structure thereof fastens the receptor insulator to have electrical contact with the receptor shielding terminal, forming a shielding loop providing shielding for the placement space, and preventing the RF plate cable or the cable end connector in the placement space from leaving via the placement opening longitudinally.

In one embodiment of the present invention, a side wall of the receptor insulator constituting the placement space may be formed with a neck for the RF plate cable or the cable end connector to enter the placement space therethrough top down. The receptor insulator may be formed with a lateral limiting mechanism to provide limiting for the RF plate cable or the cable end connector in the placement space, in order to prevent the RF plate cable or the cable end connector from leaving the placement space via the neck laterally.

Furthermore, the inner wall of the metal cover may be provided convexly with a pressing portion for pressing the RF plate cable or the cable end connector in the placement space. An outer wall of the metal cover has a tilt portion for lifting the metal cover. As the metal cover and the receptor insulator are fastened, the metal cover is in simultaneous electrical contact with the receptor shielding terminal and the RF plate cable or the cable end connector in the placement space as an electrical passage to deliver the electrical signal from the external conductors of the RF plate cable or the coaxial cable to the receptor shielding terminal.

Moreover, the present invention further provides a RF plate cable used in conjunction with the flip-cover receptor connector, having a multi-layer structure being constituted by superposing at least a plate-like central conductor, first insulators, external conductors and second insulators in sequence. The central conductor may be extended to a location for contact with the receptor central terminal contact and exposed. The first insulators may block electrical communication between the central conductor and the external conductors. The external conductors may be extended to a location for contact with the receptor shielding terminal contact and exposed. The second insulators may cover over the external conductors to provide insulation protection for the external conductors.

Furthermore, the present invention further provides a cable end connector used in conjunction with the flip-cover receptor connector and joined with a coaxial cable integrally, including a cable end insulator, a cable end central terminal and a cable end shielding terminal. The cable end central terminal has a cable end central terminal contact and a cable end central terminal join portion, the cable end central terminal contact being exposed out of a location of the cable end insulator for contact with the receptor central terminal contact, the cable end central terminal join portion being used to join a central conductor of the coaxial cable. The cable end shielding terminal may clad the cable end insulator, being provided with a cable end shielding terminal contact and a plurality of cable clamps, wherein the cable end shielding terminal contact being provided at a location for contact with the receptor shielding terminal contact, while the cable clamps are used to crimp external conductors and an external insulator of the coaxial cable, respectively.

It should be noted that an outer wall of the cable end shielding terminal may also have, for example, a foolproof structure formed of rabbet or hole in order for engagement with the metal cover fastened to the receptor insulator, such that whether or not the metal cover has reached engagement location is identified.

In comparison with prior arts, a flip-cover receptor connector of the invention has a receptor insulator, a receptor central terminal, a receptor shielding terminal and a metal cover. The receptor insulator provided in the invention is formed with a placement space opening up. The metal cover and the receptor insulator is pivoted to be forced and rotate pivotally. As the metal cover rotates pivotally in a direction away from the receptor insulator, the RF plate cable or the cable end connector may enter the placement space of the receptor insulator top down, for a receptor central terminal and a receptor shielding terminal to receive electrical signals from a central conductor and external conductors of the RF plate cable or the a coaxial cable, respectively after the metal cover fastens the receptor insulator. The metal cover further has a fastening structure, the fastening structure may be fastened with the receptor insulator to restrict a longitudinal movement of the RF plate cable or the cable end connector in the placement space by fastening force as it rotates pivotally toward the receptor insulator, thereby the total height is reduced after the flip-cover receptor connector of the invention is mated with the RF plate cable or the cable end connector in conjunction therewith.

DETAILED DESCRIPTION OF THE PREFERRED EMBODIMENT

Figure 1:
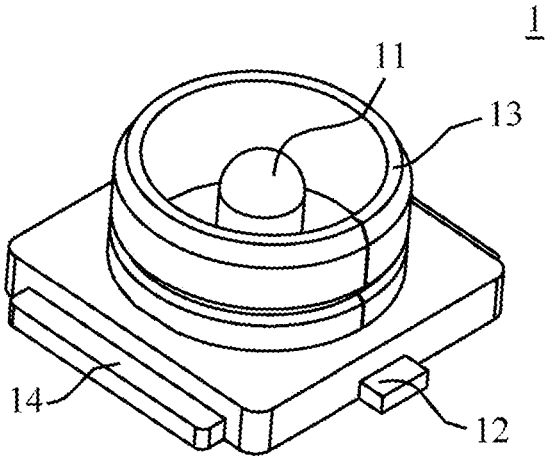
Figure 1(Prior Art)
FIG. 1 is a schematic view showing a conventional receptor connector.
Figure 2:
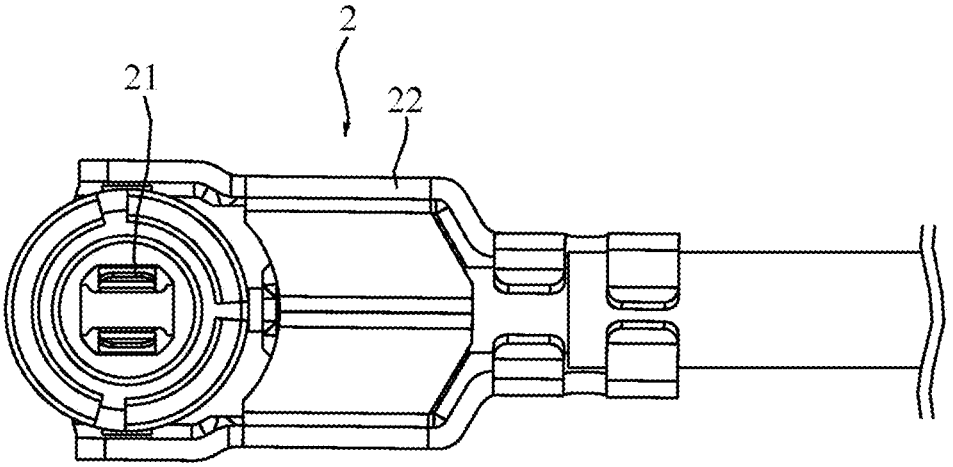
Figure 2(Prior Art)
FIG. 2 is a schematic view showing a conventional cable end connector.
Figure 3:
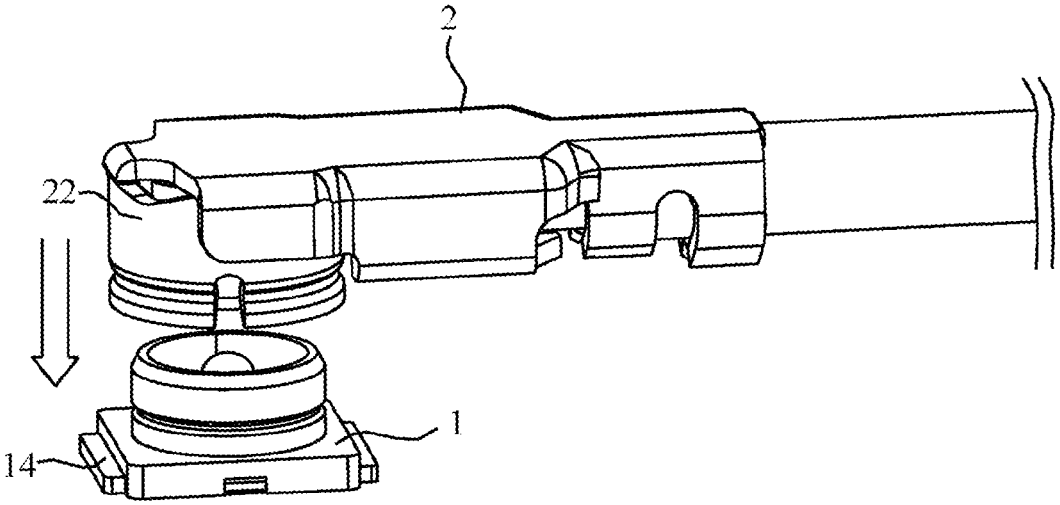
Figure 3(Prior Art)
FIG. 3 is a schematic view showing a joining action of the cable end connector shown in FIG. 2 and the receptor connector shown in FIG. 1.
Figure 4:
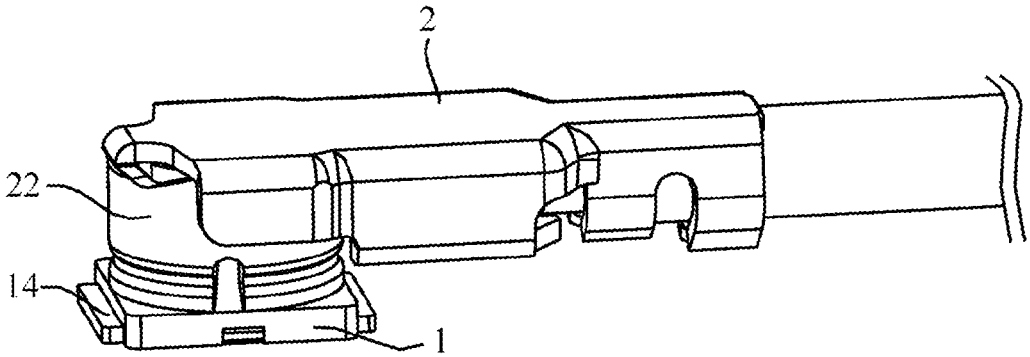
Figure 4(Prior Art)
FIG. 4 is a schematic view showing a completed joining action of the cable end connector shown in FIG. 2 and the receptor connector shown in FIG. 1.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

First Example

The example provides a receptor connector with a flip cover construction, fastening of a flip cover being utilized to achieve limiting movement of a RF plate cable, without a mating force provided by the receptor connector to a cable end connector joined with a coaxial cable, in order to reduce a height of a structure of the receptor connector effectively and to be applicable to modern thin technical products.

Figure 5:
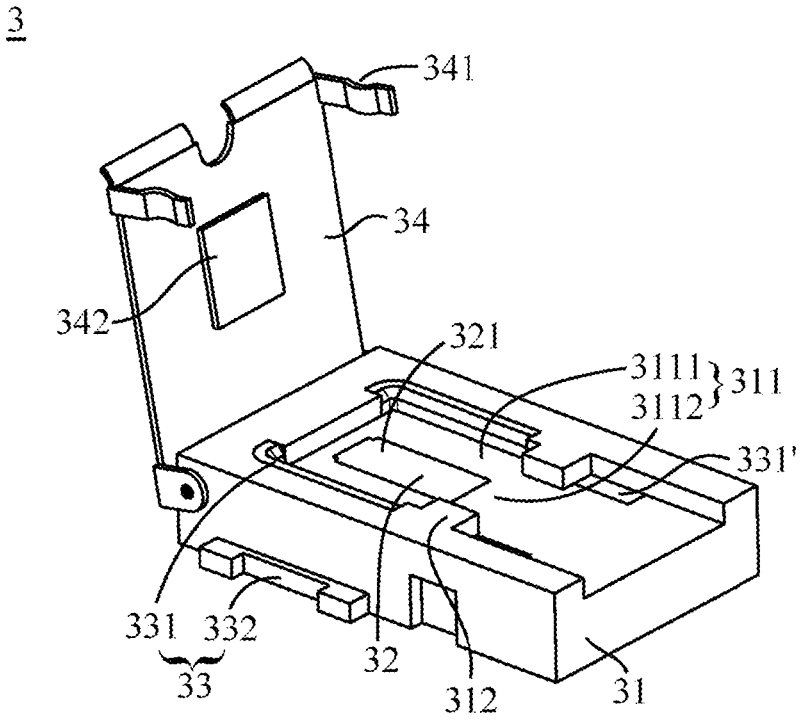
FIG. 5 is a schematic view showing a receptor connector of a first example in the invention.

Refer to FIGS. 5 to 13, which are schematic views showing a receptor connector of the example and a RF plate cable used in conjunction. As shown in FIG. 5, a shape of a flip-cover receptor connector 3 is a rectangle, but various shapes, such as a circle, may be designed, without limitation to the shape shown in the figures. The flip-cover receptor connector 3 of the example includes a receptor insulator 31, a receptor central terminal 32, a receptor shielding terminal 33, and a metal cover 34.

Figure 6:
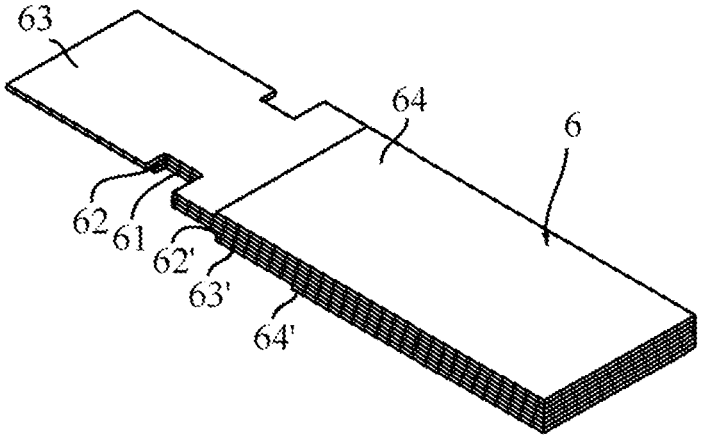
FIG. 6 is a schematic view showing a RF plate cable used in conjunction with the receptor connector shown in FIG. 5.

In the example, a RF plate cable 6, which is a plate-like multi-layer structure, used in conjunction with the above flip-cover receptor connector 3 is also provided. As shown in FIG. 6, the RF plate cable 6 may replace a conventional coaxial cable having a multi-layer concentric ring structure. The multi-layer structure of the RF plate cable 6 is constituted by superposing a plate-like central conductor 61, first insulators 62, 62', external conductors 63, 63' and second insulators 64, 64'. The first insulators 62, 62' provide insulation protection, blocking electrical communication between the central conductor 61 and the external conductors 63, 63', respectively. The second insulators 64, 64' covering over the external conductors 63, 63', respectively, to provide insulation protection for the external conductors 63, 63', respectively.

Figure 7:
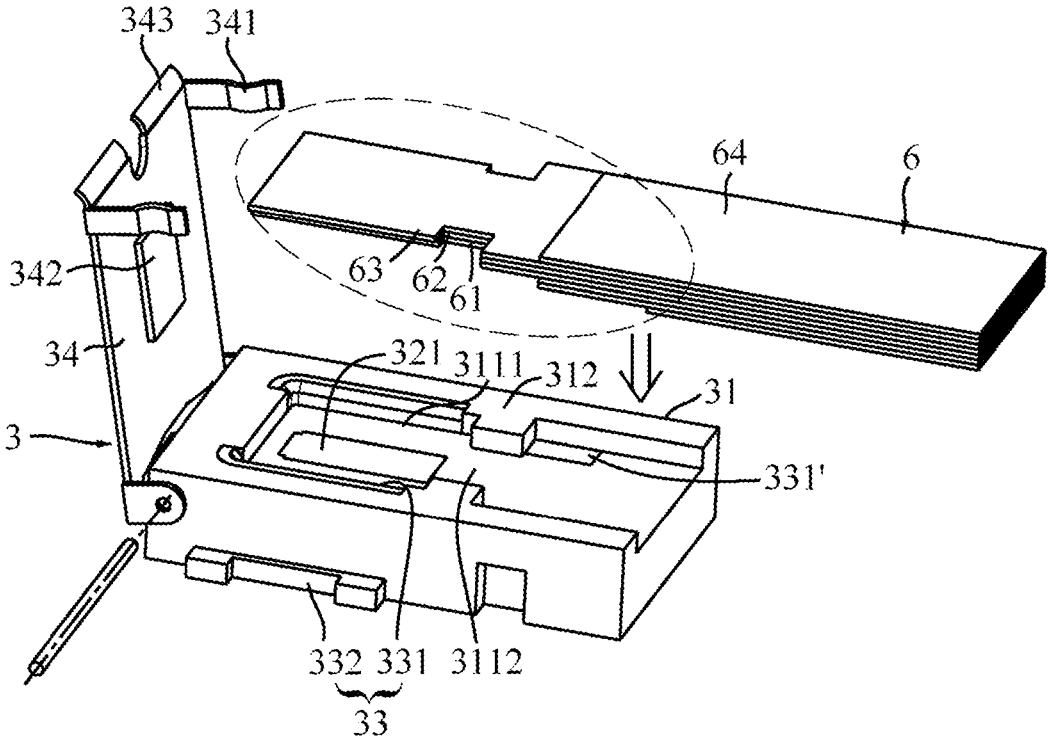
FIG. 7 is a schematic view showing a joining action of the RF plate cable shown in FIG. 6 and the receptor connector shown in FIG. 5.
Figure 8:
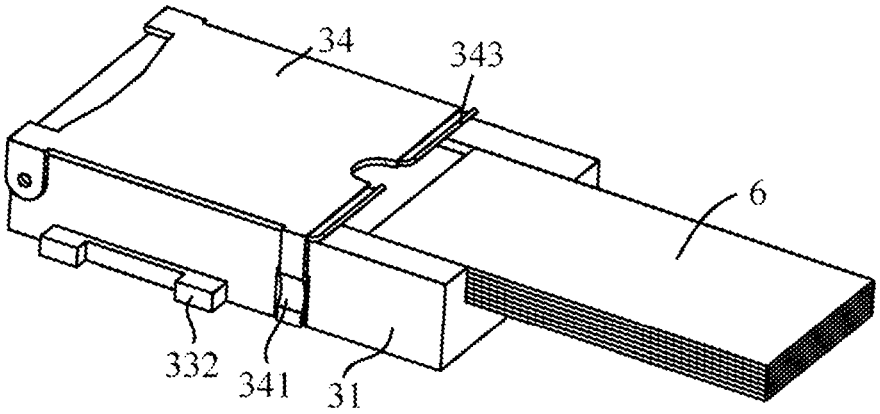
FIG. 8 is a schematic view showing a completed joining action of the RF plate cable shown in FIG. 6 and the receptor connector shown in FIG. 5.
Figure 9:
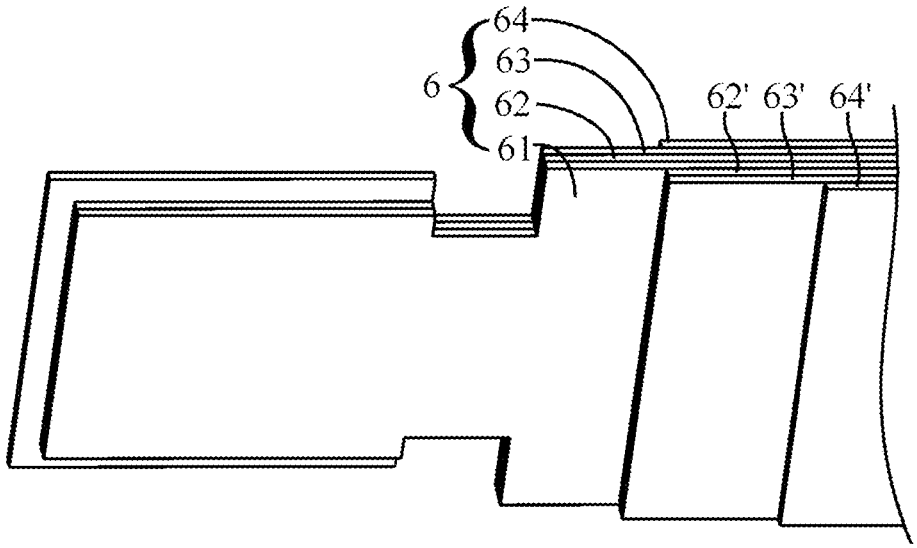
FIG. 9 is an enlarged schematic view showing the RF plate cable shown in FIG. 6 from another angle of view.
Figure 10:
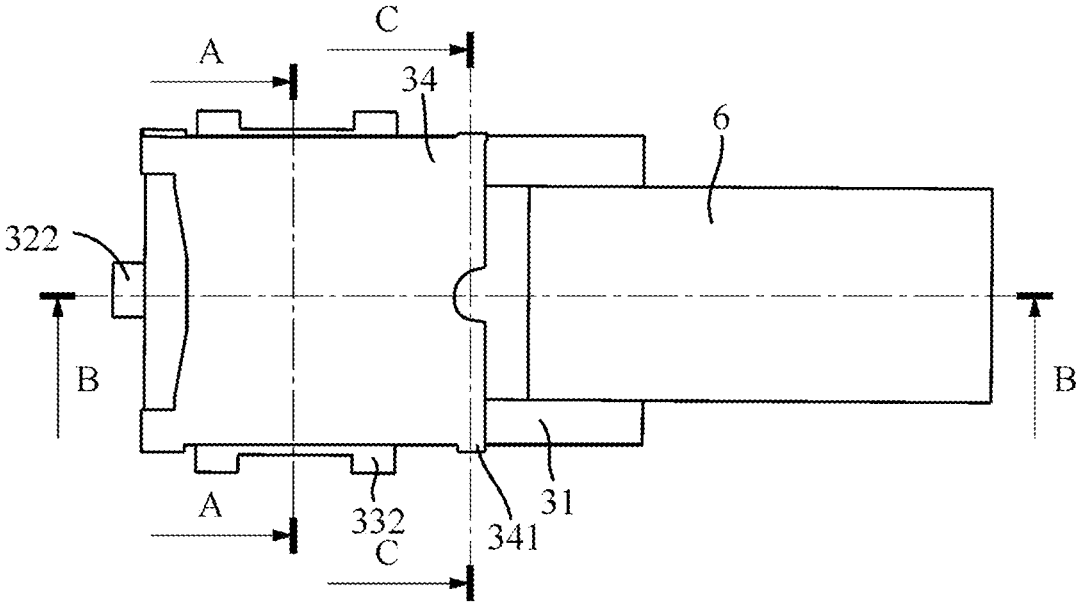
FIG. 10 is a top view showing an overall structure of the RF plate cable and the receptor connector shown in FIG. 8 after joining.

The receptor insulator 31 is provided concavely with a placement space 311, which has a placement opening 3111 opening up. As shown in FIG. 7, the RF plate cable 6 in conjunction with the flip-cover receptor connector 3 may enter the placement space 311 through the placement opening 3111 top down until abutting a bottom of the placement space 311. The receptor central terminal 32 is arranged at the receptor insulator 31, and has receptor central terminal contact 321 exposed at the bottom of the placement space 311 of the receptor insulator 31 for electrical contact with the central conductor 61 of the RF plate cable 6 in the placement space 311 of the receptor insulator 31, in order to receive an electrical signal from the central conductor 61 of the RF plate cable 6. Accordingly, the central conductor 61 of the RF plate cable 6 extends to a location corresponding to the receptor central terminal contact 321 and is exposed, such that electrical contact with the receptor central terminal contact 321 is available to deliver the electrical signal without a cable end connector. Correspondingly, the receptor central terminal 32 also has a receptor central terminal pin 322 extending out of the receptor insulator 31 (refer to FIG. 12), such that a circuit board is lapped to deliver the electrical signal from the central conductor 61 of the RF plate cable 6 to the circuit board.

A cross section of the placement space 311 may be expanded from bottom to the placement opening 3111 gradually, such that a guiding plane is provided to guide the RF plate cable 6 to enter the placement space 311 step by step, in order to solve a problem that the small-sized RF plate cable 6 cannot enter the placement space 311 easily, so that time for placing the RF plate cable into the flip-cover receptor connector may be reduced effectively. SMT high temperature resistant plastic may be selected as a material for the receptor insulator 31, formed in an embedded injection or assemblage manner to provide locating for the receptor central terminal 32 and the receptor shielding terminal 33. As shown in FIG. 7, the receptor insulator 31 also has at least one stopper 312 as a lateral limiting mechanism, the stopper 312 being extended laterally in the placement space 311 to form a neck 3112 for the RF plate cable 6 to enter the placement space 311 through top down. The stopper 312 may provide lateral limiting for the RF plate cable 6 to prevent the RF plate cable 6 from leaving the placement space 311 via the neck 3112 laterally.

The receptor shielding terminal 33 is arranged at the receptor insulator 31 to provide electrical shielding function. The receptor shielding terminal 33 has receptor shielding terminal contacts 331, 331' exposed at a lateral side and a bottom on the placement space 311 of the receptor insulator 31 for electrical contact with the external conductors 63, 63' of the RF plate cable 6, respectively, in order for electrical communication with the external conductors 63, 63' of the RF plate cable 6 to deliver the electrical signal, such as ground signal. Accordingly, the external conductors 63, 63' of the RF plate cable 6 are extend to the locations corresponding to the receptor shielding terminal contact 331, 331' and exposed, respectively, for respective electrical contact with the receptor shielding terminal contact 331, 331' and delivery of the electrical signals without the need of cable end connector. The receptor shielding terminal 33 further has receptor shielding terminal pins 332 extended out of the receptor insulator 31 for lapping a circuit board (not shown) to deliver the electrical signal from the external conductors 63, 63' of the RF plate cable 6 to the circuit board.

Figure 11:
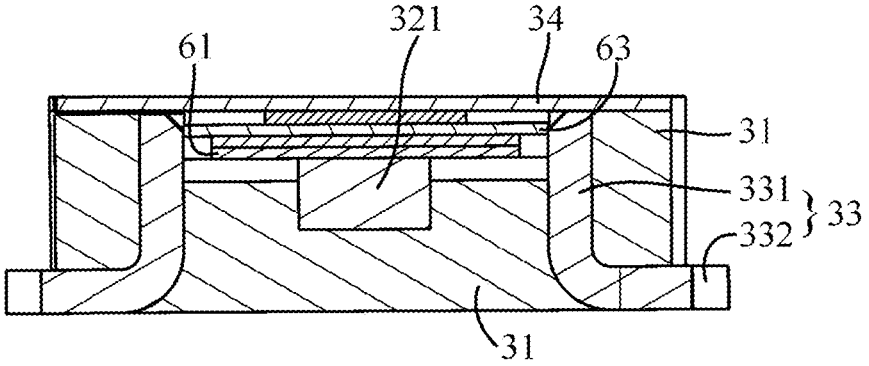
FIG. 11 is a sectional view taken along AA line in FIG. 10.
Figure 12:
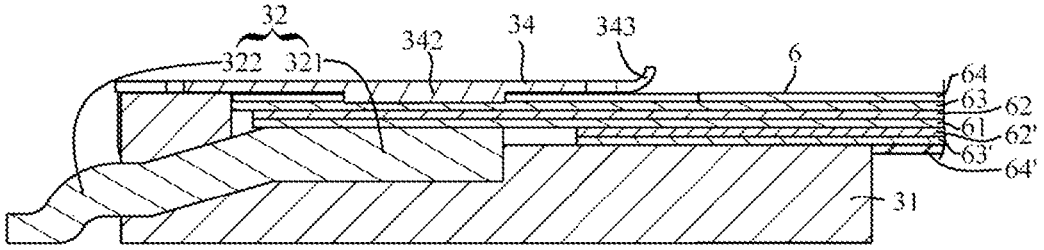
FIG. 12 is a sectional view taken along BB line in FIG. 10.

In addition, the receptor central terminal pin 322, the receptor shielding terminal pins 332 may be selected as a SMT pin or a through hole pin to combine with the circuit board. There are two receptor shielding terminal pins 332 as shown in FIG. 11, while there is one receptor central terminal pin 322 as shown in FIG. 12, but not limited thereto. The quantities of the receptor central terminal pins 322 and the receptor shielding terminal pins 332 may be adjusted as needed.

One end of a metal cover 34 is pivoted with the receptor insulator 31, while another end has a fastening structure 341. The metal cover 34 may be forced to rotate pivotally and to be lifted upwards out of the receptor insulator 31 (also known as to rotate pivotally in a direction away from the receptor insulator 31) for the placement opening 3111 of the placement space 311 to be exposed, and for the RF plate cable to enter the placement space 311 via the placement opening 3111 top down smoothly.

The metal cover 34 may also be forced to rotate pivotally until the fastening structure 341 thereof has fastened the receptor insulator 31 for an inner wall to provide the RF plate cable 6 with a pressing force via the placement opening 3111, in order to prevent the RF plate cable 6 from leaving the placement space 311 longitudinally via the placement opening 3111 bottom up, so that the metal cover 34 fastened with the receptor insulator 31 may prevent effectively the RF plate cable 6 from detaching the flip-cover receptor connector 3 longitudinally.

In other words, the longitudinal limiting provided for the RF plate cable 6 by the flip-cover receptor connector 3 of the example is achieved by means of a fastening force of the metal cover 34 and the receptor insulator 31. As such, even though the mating height that the flip-cover receptor connector 3 may provide for the RF plate cable 6 is very small, a sufficient longitudinal limiting force for the RF plate cable 6 may still be provided by means of fastening of the metal cover 34 and the receptor insulator 31, such that the RF plate cable 6 will not be susceptible to an external force and detach the flip-cover receptor connector 3.

The inner wall of the metal cover 34 is provided convexly with a pressing portion 342 for pressing the RF plate cable 6 in the placement space 311. The electrical contact of the receptor central terminal contact 321 and the central conductor 61 of the RF plate cable 6 is guaranteed with a pressing thrust. Even more, the electrical contact of the receptor shielding terminal contact 331' and the external conductors 63' of the RF plate cable 6 may also be guaranteed.

Figure 13:
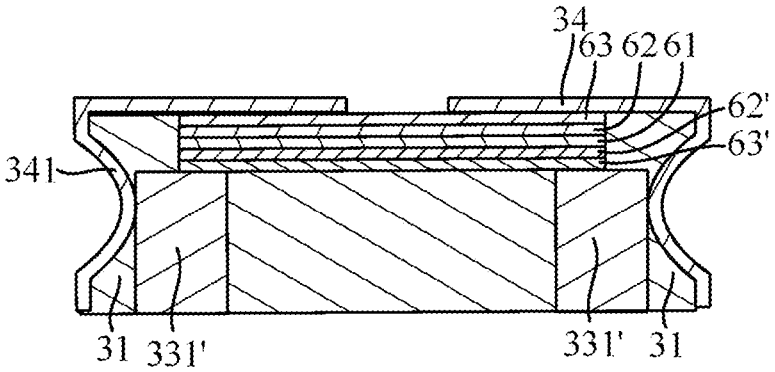
FIG. 13 is a sectional view taken along CC line in FIG. 10.
Figure 14:
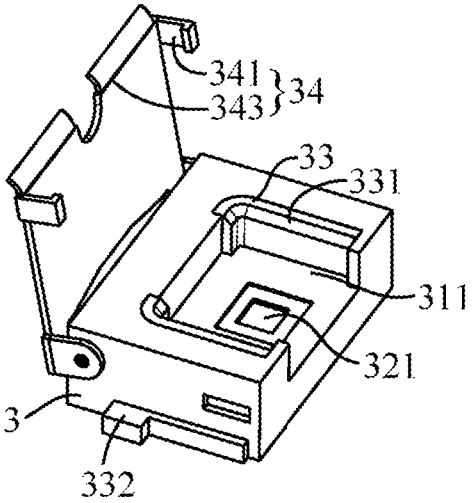
FIG. 14 is a schematic view showing a receptor connector of a second example in the invention.

As shown in FIG. 11, as the metal cover 34 and the receptor insulator 31 are fastened, the metal cover 34 may be in electrical contact with the external conductors 63 of the RF plate cable 6 as an electrical passage. Additionally, as shown in FIG. 13, as the fastening structure 341 of the metal cover 34 fastens the receptor insulator 31, the fastening structure 341 may also be extended into the receptor insulator 31 for electrical contact with the receptor shielding terminal contact 331', in order to allow electrical communication for the external conductors 63, 63' of the RF plate cable 6 by means of the metal cover 34 to form a shielding loop providing shielding for the placement space 311 of the receptor insulator 31.

As shown in FIG. 12, an outer wall of the metal cover 34 has a tilt portion 343 for ease of forcing to exert a pivotally rotating force to the metal cover 34, such that the metal cover 34 is lifted from the receptor insulator 31 or the metal cover 34 and the receptor insulator 31 are fastened.

Second Example

The same or like elements in the example and the first example are shown in the same or like element numerals and detailed narration thereof is omitted for technical illustration of the example to be understood more easily.

A cable end connector joined with a coaxial cable is provided in the example, which may be used in conjunction with the receptor connector having a flip cover construction disclosed in the first example to reduce an entire height of a structure effectively after mating the cable end connector and the receptor connector, and is applicable to modern thin technical products.

Figure 15:
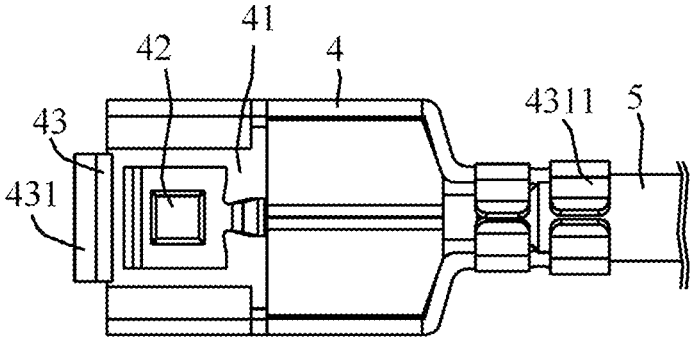
FIG. 15 is a schematic view showing a cable end connector of a second example in the invention.

Refer to FIGS. 14 to 20, which are schematic views showing the flip-cover receptor connector and the cable end connector used in conjunction therewith in the example, respectively. As shown in FIG. 15, the cable end connector 4 may include a cable end insulator 41, a cable end central terminal 42 and a cable end shielding terminal 43. The cable end central terminal 42 and the cable end shielding terminal 43 may be made by means of stamping with optional surface treatment to increase service life. In the example, a head end of the cable end shielding terminal 43 is designed as a rectangle, but not limited thereto, which may be changed to a polygon, circular arc, ellipse or irregular shape in correspondence to the flip-cover receptor connector in conjunction.

Figure 16:
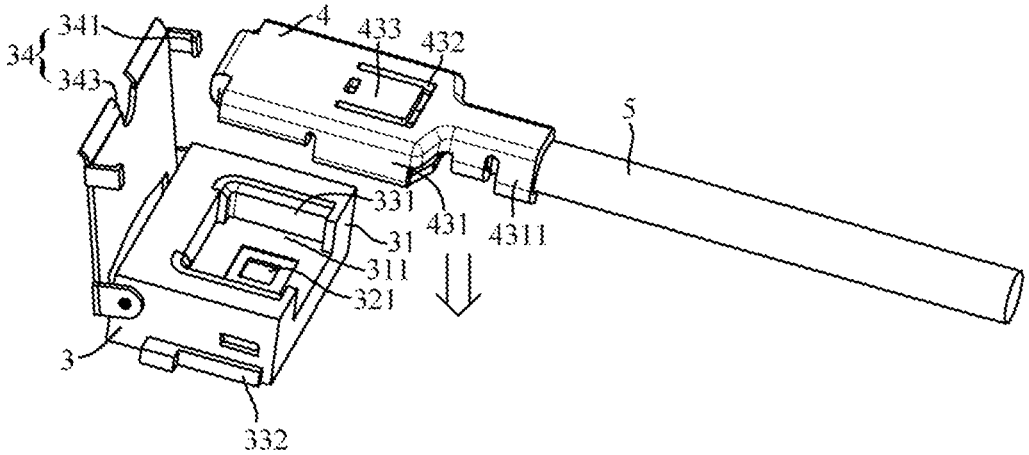
FIG. 16 is a schematic view showing a joining action of the cable end connector shown in FIG. 15 and the receptor connector shown in FIG. 14.
Figure 17:
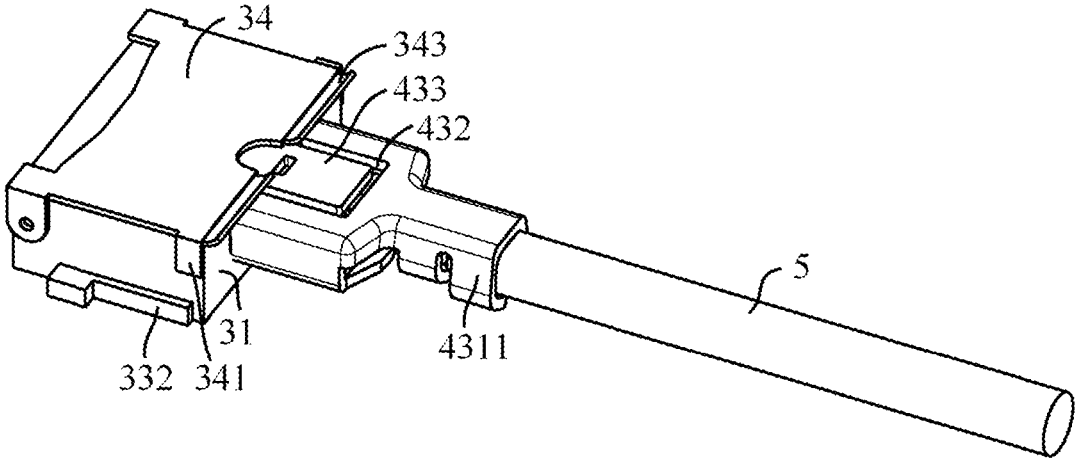
FIG. 17 is a schematic view showing a completed joining action of the cable end connector shown in FIG. 15 and the receptor connector shown in FIG. 14.
Figure 18:
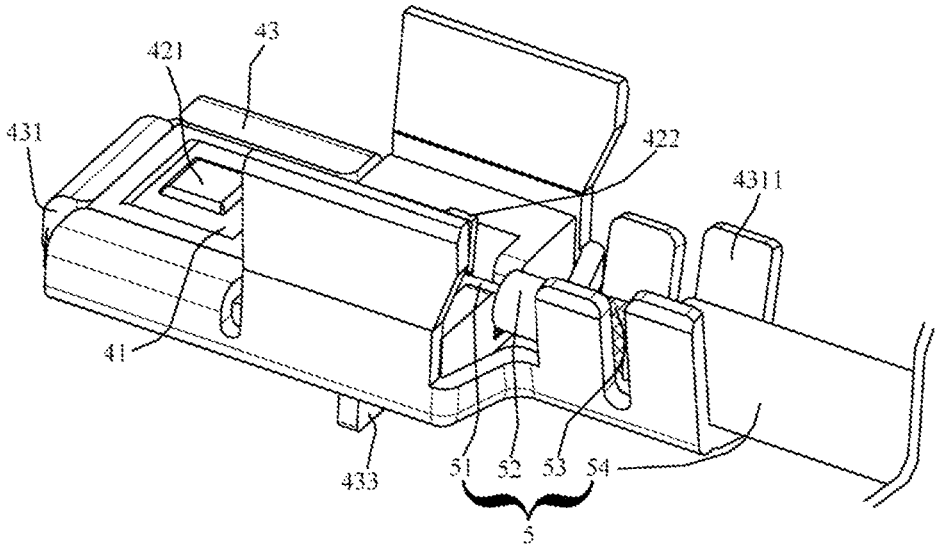
FIG. 18 is a schematic view showing disassembly for partial members of the cable end connector shown in FIG. 15 from a first angle of view.

As shown in FIG. 16, the cable end connector 4 may enter the placement space 311 of the flip-cover receptor connector 3 top down until abutting the bottom of the placement space 311. As shown in FIG. 17, as the metal cover 34 and the receptor insulator 31 are fastened, the cable end central terminal is allowed for electrical contact with the receptor central terminal, and the cable end shielding terminal is allowed for electrical contact with the receptor shielding terminal for respective delivery of the electrical signal of the central conductor of the coaxial cable 5 and the external conductors.

Figure 19:
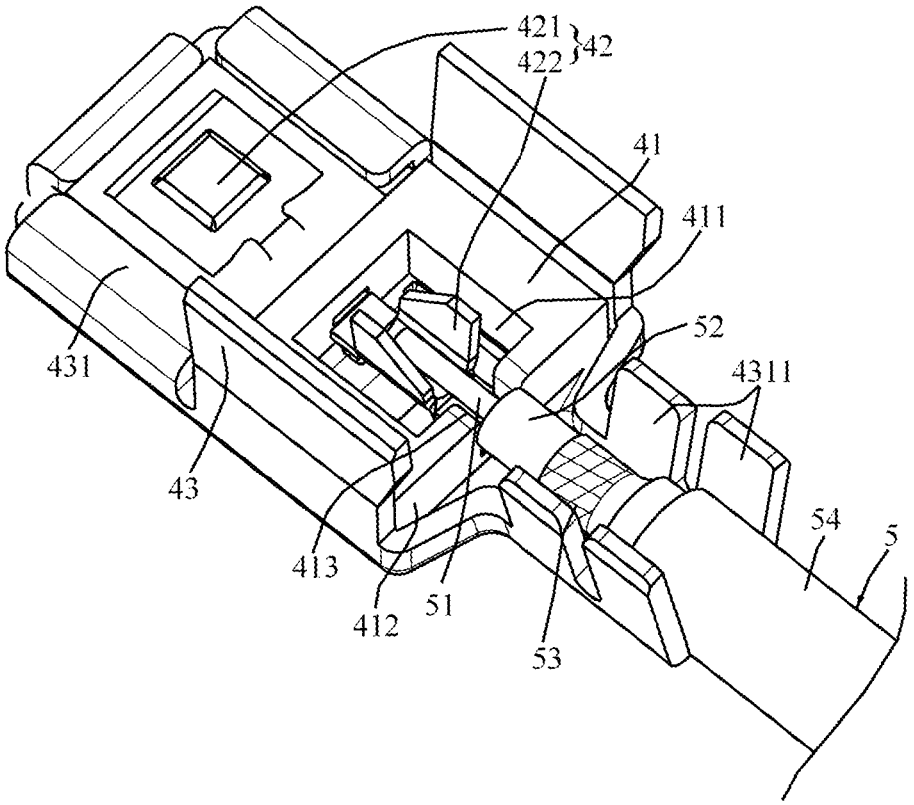
FIG. 19 is a schematic view showing disassembly for partial members of the cable end connector shown in FIG. 15 from a second angle of view.
Figure 20:
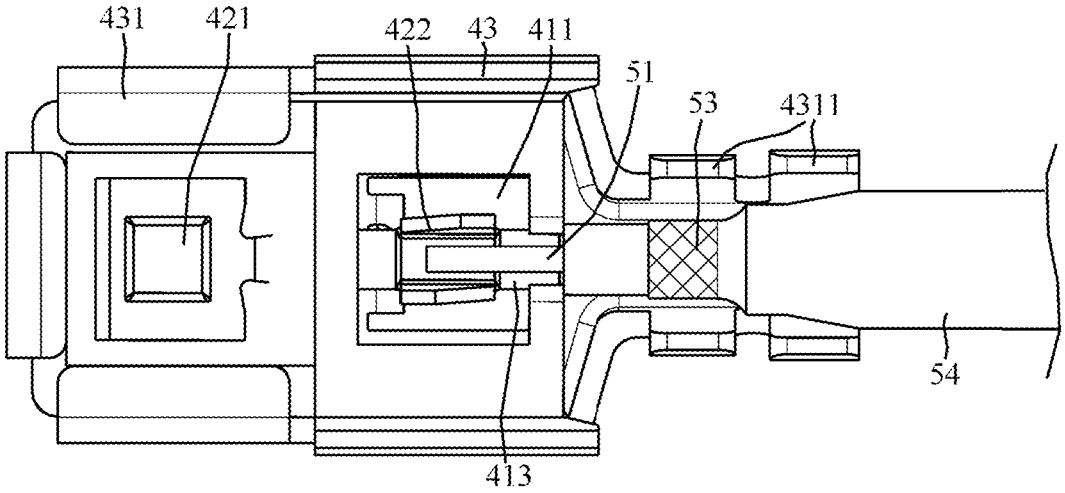
FIG. 20 is a schematic view showing disassembly for partial members of the cable end connector shown in FIG. 15 from a third angle of view.

As shown in FIG. 19, the cable end central terminal 42 has a cable end central terminal contact 421 and a cable end central terminal join portion 422 on head and tail ends of the cable end insulator 41, respectively. The cable end central terminal contact 421 is exposed at a location where the cable end insulator 41 is in contact with the receptor central terminal contact for accomplishing the electrical contact of the cable end central terminal 42 and the receptor central terminal. The cable end central terminal join portion 422 is used to join the central conductor 51 of the coaxial cable 5.

The form and structure of the cable end shielding terminal 43 is designed to fit the form and structure of the cable end insulator 41, such that the cable end insulator 41 may be cladded and contained therein. Head end of the cable end shielding terminal 43 are provided with a cable end shielding terminal contact 431, and tail end of the cable end shielding terminal 43 are provided with a plurality of cable clamps 4311, wherein the cable end shielding terminal contact 431 is provided at a location for contact with the receptor shielding terminal contact in order for subsequent accomplishment of electrical contact between the cable end shielding terminal 43 and the receptor shielding terminal 33. Those cable clamps 4311 may be crimped with the external conductors 53 and an external insulator 54 of the coaxial cable 5 integrally, respectively, for the cable end shielding terminal 43 to be capable of providing functions of electrical shielding and delivering ground signal. An outer wall of the cable end shielding terminal 43 may also have, for example, a foolproof structure formed of rabbet or hole in order for engagement with the metal cover fastened to the receptor insulator, such that whether or not the metal cover has reached engagement location is identified.

A raw empty hole 432 is formed on the cable end shielding terminal 43 at a location corresponding to the cable end central terminal join portion 422, and a peripheral wall of the raw empty hole 432 is extended out of a cover plate 433. The raw empty hole 432 can be shielded after the cover plate 433 is bent. A support may penetrate into the raw empty hole 432 which is not shielded by the cover plate 433 to provide support as the cable end central terminal join portion 422 joins the central conductor 51, such that the cable end central terminal join portion 422 and the central conductor 51 may be crimped integrally. After the cable end central terminal join portion 422 and the central conductor 51 have been crimped, the cover plate 433 may be bent to shield the raw empty hole 432 in order to provide shield for crimping portion of the cable end central terminal join portion 422 and the central conductor 51. It should be noted that the cable end central terminal join portion 422 may also join the central conductor 51 of the coaxial cable 5 by means of press bond, soldering or IDC (insulation displacement connection) etc., not limited to crimping disclosed in the example.

A hollow frame design is used for the cable end insulator 41, at which tail end a through-hole 411 for containing the cable end central terminal join portion 422 is formed in a middle portion. Further, A trench 413 is formed on a side wall 412 on which the cable end insulator 41 and the through-hole 411 are adjacent for the central conductor 51 of the coaxial cable 5 to pass and enter the through-hole 411 and join with the cable end central terminal join portion 422. The outer wall of the side wall 412 may also be provided for a front end of an internal insulation layer 52 of the coaxial cable 5 to abut in favor of subsequent join operation of the central conductor 51 and the cable end central terminal join portion 422, and maintaining suspension of the central conductor 51 in the trench 413, while the central conductor 51 and the cable end shielding terminal 43 are separated to prevent electrical signal transmission of the central conductor 51 from influence due to interference.

In addition, a pair of wing panels are extended on both sides of a tail portion of the cable end shielding terminal 43. The pair of wing panels may be bent inward relatively to cover the through-hole 411, and provide shield for the join portion of the cable end central terminal join portion 422 and the central conductor 51 to reduce the extent of external influence for signal delivery of central conductor 51.

In summary, the invention provides a flip-cover receptor connector and a RF plate cable used in conjunction therewith and a cable end connector joined with a coaxial cable. The flip-cover receptor connector of the invention has a receptor insulator, a receptor central terminal, a receptor shielding terminal and a metal cover. The receptor insulator has a placement space for accommodating the RF plate cable or the cable end connector. One end of a metal cover and the receptor insulator is pivoted to be forced and rotate pivotally. As the metal cover rotates pivotally in a direction away from the receptor insulator, a placement space of the receptor insulator is exposed, so that the RF plate cable or the cable end connector may be placed. A receptor central terminal is used to receive electrical signal from the RF plate cable or the central conductor of the coaxial cable. A receptor shielding terminal is used to receive electrical signal from the RF plate cable or the external conductors of the coaxial cable.

Another end of the metal cover has a fastening structure. As the metal cover rotates pivotally in a direction toward the receptor insulator, the fastening structure of the metal cover may be fastened with the receptor insulator. Thereby, longitudinal movement of the RF plate cable or the cable end connector in the placement space is restricted. As such, a sufficient restriction force may be provided for longitudinal movement of the RF plate cable or the cable end connector by fastening the metal cover and the receptor insulator even though height of the flip-cover receptor connector is very small, such that it does not tend to leave the placement space of the receptor insulator due to external force impact. Thus, the structure height after combining the flip-cover receptor connector and the RF plate cable or the cable end connector in conjunction therewith according to the invention may be reduced effectively to be applicable to modern or future thin technical products.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. A flip-cover receptor connector (3) used in conjunction with a radio frequency RF plate cable (6) or a cable end connector (4) joined with a coaxial cable (5), including:

a receptor insulator (31) provided concavely with a placement space (311) having a placement opening (3111), the RF plate cable (6) or the cable end connector (4) being capable of entering the placement space (311) through the placement opening (3111); the receptor insulator (31) being further formed with a lateral limiting mechanism to provide limiting for the RF plate cable (6) or the cable end connector (4) in the placement space (311), in order to prevent the RF plate cable (6) or the cable end connector (4) from leaving the placement space (311) laterally;

a receptor central terminal (32) provided at the receptor insulator (31) and having a receptor central terminal contact (321) exposed at the bottom of the placement space (311) of the receptor insulator (31) for electrical contact with the RF plate cable (6) or the cable end connector (4) to receive an electrical signal from a central conductor (61, 51) of the RF plate cable (6) or the coaxial cable (5), the receptor central terminal (32) further having a receptor central terminal pin (32) extending out of the receptor insulator (31);

a receptor shielding terminal (33) arranged at the receptor insulator (31), having a receptor shielding terminal contact (331) exposed at a lateral side of the placement space (311) of the receptor insulator (31) for electrical contact with the RF plate cable (6) or the cable end connector (4) to receive an electrical signal from external conductors (63, 53) of the RF plate cable (6) or the coaxial cable (5), the receptor shielding terminal (33) further having receptor shielding terminal pins (332) extending out of the receptor insulator (31); and a metal cover (34), one end being pivoted on the receptor insulator (31), another end having a fastening structure (341), the metal cover (34) can be forced to rotate pivotally until the fastening structure (341) thereof fastens the receptor insulator (31) to have electrical contact with the receptor shielding terminal (33), forming a shielding loop providing shielding for the placement space (311), and preventing the RF plate cable (6) or the cable end connector (4) in the placement space (311) from leaving via the placement opening (3111) longitudinally.

2. The flip-cover receptor connector (3) according to claim 1, wherein a side wall of the receptor insulator (31) constituting the placement space (311) is formed with a neck (3112) for the RF plate cable (6) or the cable end connector (4) to enter the placement space therethrough top down.

3. The flip-cover receptor connector (3) according to claim 1, wherein the inner wall of the metal cover (34) is provided convexly with a pressing portion (342) for pressing the RF plate cable (6) or the cable end connector (4) in the placement space (311), to guarantee the receptor central terminal contact (321) and the RF plate cable (6) or the cable end connector (4) with electrical contact, and to guarantee the receptor shielding terminal contact (331) and the RF plate cable (6) or the cable end connector (4) with electrical contact.

4. The flip-cover receptor connector (3) according to claim 1, wherein an outer wall of the metal cover (34) has a tilt portion (343) for lifting the metal cover (34); wherein as the metal cover (34) and the receptor insulator (31) are fastened, the metal cover (34) is in simultaneous electrical contact with the receptor shielding terminal (33) and the RF plate cable (6) or the cable end connector (4) in the placement space (311) as an electrical passage to deliver the electrical signal from the external conductors (63, 53) of the RF plate cable (6) or the coaxial cable (5) to the receptor shielding terminal (33).

5. A RF plate cable (6) used in conjunction with the flip-cover receptor connector (3) according to claim 1, having a multi-layer structure being constituted by superposing at least a plate-like central conductor (61), first insulators (62), external conductors (63) and second insulators (64) in sequence; the central conductor (61) being extended to a location for contact with the receptor central terminal contact (321) and exposed; the first insulators (62) blocking electrical communication between the central conductor (61) and the external conductors (63); the external conductors (63) being extended to a location for contact with the receptor shielding terminal contact (331) and exposed; the second insulators (64) covering over the external conductors (63) to provide insulation protection for the external conductors (63).

6. A cable end connector (4) used in conjunction with the flip-cover receptor connector (3) according to claim 1, joined with a coaxial cable (5) integrally, including:

a cable end insulator (41);

a cable end central terminal (42) having a cable end central terminal contact (421) and a cable end central terminal join portion (422), the cable end central terminal contact (421) being exposed out of a location of the cable end insulator (41) for contact with the receptor central terminal contact (321), the cable end central terminal join portion (422) being used to join a central conductor (51) of the coaxial cable (5); and a cable end shielding terminal (43) cladding the cable end insulator (41), being provided with a cable end shielding terminal contact (431) and a plurality of cable clamps (4311), the cable end shielding terminal contact (431) being provided at a location for contact with the receptor shielding terminal contact (331), while the cable clamps (4311) are used to crimp external conductors (53) and an external insulator (54) of the coaxial cable (5), respectively.

7. The cable end connector (4) according to claim 6, wherein the cable end central terminal join portion (422) join the central conductor (51) of the coaxial cable (5) by means of crimping, press bond, soldering or insulation displacement connection IDC.

* * * * *